US007267843B2

(12) United States Patent
Jahn et al.

(10) Patent No.: US 7,267,843 B2
(45) Date of Patent: Sep. 11, 2007

(54) TEXTILE FABRIC AND YARN COMPOSED OF SYNTHETIC FIBERS, PREPARATION THEREOF AND USE THEREOF

(76) Inventors: Bernhard Jahn, Ulrichstrasse 9, D-86368 Klosterlechfeld (DE); Gerhard Leumer, Lechallee 38b, D-86399 Bobingen (DE); August Schneider, Auenweg 29, D-86845 Grossaitingen (DE)

( * ) Notice: Subject to any disclaimer, the term of this patent is extended or adjusted under 35 U.S.C. 154(b) by 384 days.

(21) Appl. No.: 10/646,113

(22) Filed: Aug. 22, 2003

(65) Prior Publication Data

US 2004/0121677 A1 Jun. 24, 2004

(30) Foreign Application Priority Data

Aug. 26, 2002 (DE) ..... 102 39 004

(51) Int. Cl.
*B32B 5/02* (2006.01)
*C23C 16/00* (2006.01)

(52) U.S. Cl. ..... 427/255.24; 427/248.1; 427/402; 442/82

(58) Field of Classification Search ..... 428/364; 442/82, 88, 94, 98; 427/248.1, 255.23, 255.24, 427/402, 412
See application file for complete search history.

(56) References Cited

U.S. PATENT DOCUMENTS 3,071,565 A 1/1963 Davis, Jr. et al.
4,020,223 A 4/1977 Dixon et al.
4,698,110 A 10/1987 Vassiliou
5,397,629 A * 3/1995 Jahn ..... 442/164
6,280,880 B1 8/2001 Schwoebel et al.

FOREIGN PATENT DOCUMENTS

| | | |
|---|---|---|
| CA | 1336636 | 8/1995 |
| DE | 3301270 A1 | 7/1984 |
| DE | 199 31 348 C1 | 1/2001 |
| EP | 0 224 262 A2 | 6/1987 |
| EP | 0 327 047 B1 | 8/1989 |
| EP | 9 327 047 | 8/1989 |

* cited by examiner

*Primary Examiner*—Lynda M. Salvatore
(74) *Attorney, Agent, or Firm*—Morgan, Lewis & Bockius LLP

(57) ABSTRACT

Textile fabric composed of synthetic fibers is subjected to a gas phase fluorination in a fluorine/inert gas atmosphere having a fluorine concentration in the range from 0.1 to 10% in order that the synthetic fiber surfaces may be activated in such a way that they are able to react with organic or inorganic compounds. Thereafter, the fabric is coated with a fluorocopolymer which is free of adhesion promoters. Similarly, yarn composed of synthetic fibers is first gas phase fluorinated and thereafter coated with a fluorocopolymer. Sewing yarn or thread, having been gas phase fluorinated, is bonded by means of a fluoropolymer coating. The improved adhesion makes the coated materials useful for a wide range of industrial applications.

16 Claims, 2 Drawing Sheets

Figure 1:
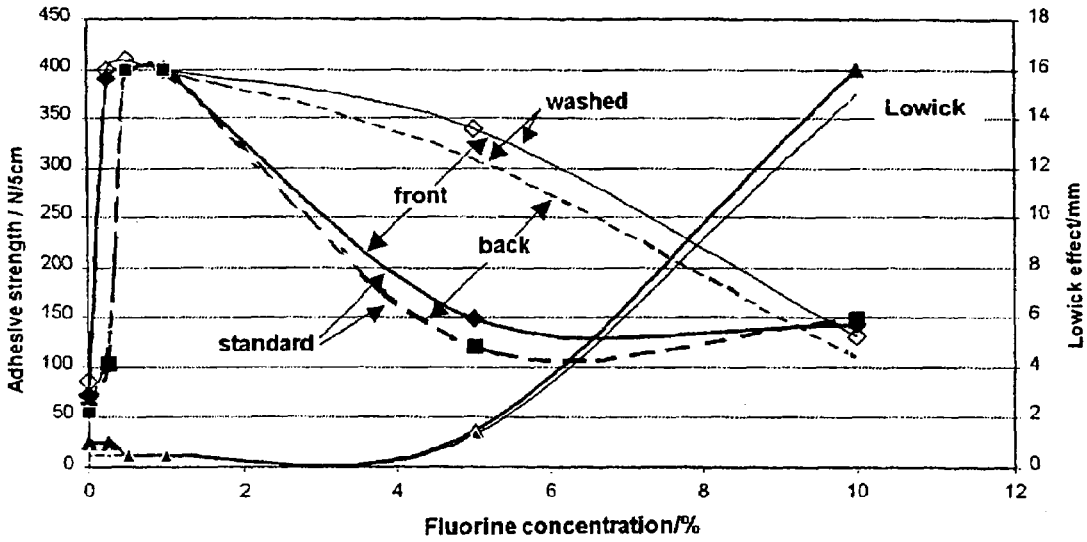

T 711 adhesion as a function of fluorination

T 710 adhesion as a function of fluorination

TEXTILE FABRIC AND YARN COMPOSED OF SYNTHETIC FIBERS, PREPARATION THEREOF AND USE THEREOF

BACKGROUND OF THE INVENTION

1. Field of the Invention

This invention relates to a textile fabric and yarn composed of synthetic fibers coated with fluoropolymer and also to the preparation of textile sheet material and yarn and the use thereof.

2. Description of Related Art

EP 0 327 047 B1 discloses aqueous fluoropolymer formulations containing in finely divided form from 25% to 60% by weight of a fluoropolymer, from 1% to 5% by weight of an organic compound containing at least two isocyanate groups and optionally up to 10% by weight of auxiliary or additive materials. These fluoropolymer formulations are used for coating yarn and textile sheet materials composed of dyed or undyed, flat or textured synthetic filaments or fibers and for bonding sewing yarn. The textile sheet materials coated with such fluoropolymer compositions comprise, at least in the fluoropolymer layer which is immediately adjacent to the fiber surface, one or more adhesion-promoting constituents which are derived from an organic compound containing two or more isocyanate groups. The adhesive strength of the fluoropolymer layer as measured in line with DIN 53530 is at least 10 daN/5 cm.

EP 0 224 262 A discloses laminating sheetlike textile materials on both sides with a polyvinyl fluoride film. In this known process, a solution of the polymer in an organic solvent is poured onto a conveyor belt to form a thin layer which is caused to gel by heating. The gel layer is then pressed onto the surface of the textile material to be laminated. In this process, the fluoropolymer is only fixed on the surface of the textile material and there is virtually no impregnation of the individual filaments with the fluoropolymer.

German Offenlegungsschrift DE 33 01 270 A discloses a process for sheathing fiber or filament yarns with a fluorine-containing polymer. In this costly and inconvenient process, the filament to be sheathed is pulled through a central hole in an annular spinneret while at the same time a tube of fluoropolymer is extruded from the annular spinneret. The extruded tube therefore forms a loose-fitting sheath around the filament drawn out of the central hole. No firm bond is established between the fluoropolymer tube and the filament sheathed therewith.

It is also known to manufacture awnings, air-houses, flexible containers and similar products by coating textile sheet structures, usually woven fabrics, preferably those made of synthetic organic fibers or filaments, with polymer materials, usually with polyvinyl chloride (PVC). This coating is effected by impregnating the textile materials in suspensions of polyvinyl chloride in organic liquids. In the course of this coating, even the individual filaments of the textile material become enveloped by the polyvinyl chloride coating. To obtain sufficient adhesion between the polyvinyl chloride coating and the synthetic fiber, the coating is carried out in two stages. First a basecoat is applied comprising a mixture of a PVC paste or suspension with an adhesion promoter; this is followed by the application of a topcoat comprising a straight PVC formulation. The adhesion promoters which are suitable for this process are known. It is usual to use two-component adhesives comprising an organic substance having a plurality of hydroxyl groups, preferably a hydroxyl-containing polyester, and an organic substance having a plurality of isocyanate groups.

It is also already known to coat materials such as threads or sheetlike structures made of organic synthetic fibers with fluoropolymers in order that particularly advantageous properties, for example a low coefficient of friction, a high chemical resistance and a soil-repellent effect, may be conferred on their surfaces. Toward this end, the synthetic fiber materials are impregnated or slip-coated with commercially available aqueous dispersions of fluoropolymers and the resulting polymer coating is fixed by means of a heat treatment.

U.S. Pat. No. 3,071,565 discloses a process for converting linear elastomeric or thermoplastic chlorofluoropolymers such as, for example, mono- or copolymers of 2-chloroperfluoropropylene, chlorotrifluoroethylene, bromotrifluoroethylene, trifluoroethylene, chlorofluoroethylene and vinylidene fluoride, into cross-linked, space polymers in order that their solubility and their thermoplastic flow may be reduced and the elastomers may be subjected to a mild vulcanization as it were.

This object is said to be achieved by this reference by allowing the chlorofluoropolymers to react with polyisocyanates in the presence of moisture. However, the reference says nothing about coating fiber materials with fluoropolymers and does not in any way address the problems of adhesion between fluoropolymers and synthetic fibers.

However, in order to make composite materials based on fluoropolymer-treated synthetic fibers suitable for a wide range of applications, for example the manufacture of membranes for textile building construction, flexible containers, conveyor belts and fabric tubes, it is absolutely necessary that the fluoropolymer should possess adequate adhesion to the synthetic fiber. Adhesion or adhesive strength is here to be understood as meaning the resistance to separation of base material and coating for a 5 cm wide strip as determined in line with German standard specification DIN 53530. Adequate performance capability of the composite is ensured when, depending on the planned application, adhesion values from 100 to 150 N/5 cm are achieved. There are some applications where it is even desirable to have adhesion values of more than 200 N/5 cm.

However, the production of strongly adherent fluoropolymer coatings on synthetic fiber materials presents even greater difficulties than the production of polyvinyl chloride coatings. This is because it is found that fluoropolymers are far more inert with regard to synthetic fibers, for example polyester fibers, polyamide fibers or aramid fibers, than is polyvinyl chloride; that is, they show great reluctance to enter permanent physical or chemical bonds with synthetic fiber surfaces. Moreover, fluoropolymers which, on the basis of their physical data, might be thought suitable for use as a coating agent for synthetic fibers are generally commercially available in the form of aqueous dispersions or pastes. It is therefore not possible using these known fluoropolymer dispersions or pastes to produce coatings on synthetic fiber material which exhibit adequate adhesive strength for all the industrial uses mentioned above.

Nor is it possible to obtain a significant improvement in the adhesion of fluoropolymer coatings by using the one- or two-component adhesion promoters used successfully in the production of PVC coatings.

The firmly adherent fluoropolymer coatings on synthetic fiber which are known from EP 0 327 047 B1 contain an organic compound having a plurality of isocyanate groups instead of a conventional adhesion promoter. Known fluoropolymers include commercially available tetrafluoroethylene copolymers which contain hexafluoropropylene and vinylidene fluoride structural repeat units.

Organic compounds which have a plurality of isocyanate groups and which are incorporated in fluoropolymer formulations are available as a commercial material. Useful di- and polyisocyanates include for example the isomeric 2,4-diisocyanatotoluene and its mixtures, 1,5-diisocyanatonaphthalene, diisocyanatodiphenylmethane and its technical grade isomer mixtures, dimerized and trimerized 2,4-diisocyanatotoluene, adducts of diisocyanatotoluene with trimethylolpropane and tris[isocyanatohexyl]biuret. Particular preference for use in the fluoropolymer formulations according to the invention is given to the aforementioned derivatives of diisocyanatotoluene, especially its dimerization product, which has heretofore been marketed by Bayer AG under the name of ®Desmodur TT.

Gas phase fluorination provides prolonged high-level activation to polymeric surfaces. Fluorine is the most reactive element in the Periodic Table and therefore can be made to react with almost all organic and inorganic compounds in controllable reactions even at room temperature without further activation by means of catalysts or UV light. Fluorination replaces some of the hydrogen atoms in the polymer surface by fluorine atoms. This creates an active surface on which mechanical and chemical bonds can form. Gas phase fluorination is available from various suppliers on a tolling basis and forms part of the background art. A gas phase pretreatment with fluorine in the absence of oxygen, ie in a vacuum or in a fluorine/inert gas mixture, is a fluorination in the proper sense. When, in contrast, oxygen is likewise present in the reaction space, the reaction is an oxyfluorination. With this kind of activation, the free-radical sites on the carbon chain are observed to locate not only fluorine atoms but also hydroxyl and carboxyl groups, which likewise enhances surface activity. Suitable substrates for oxyfluorination include all industrial textiles, films, foams and the like, to render them hydrophilic for example. Fluorination and oxyfluorination each employ a mixture of up to 10% of fluorine in 90% of inert carrier gas or oxygen-enriched carrier gas (eg air), whereby industrial textiles, polymeric films, foams, yarns and the like are generally activated by the inline process in which the material passes from reel to reel through a chamber of the reactive medium. The actual condition chosen in each case are dependent inter alia on the treatment duration, the polymer type, the yarn properties (filament fineness, degree of entangling, surface pretreatment, etc.) and the fabric construction (density, weight, etc.). (Compare, for example, Dr. R. Milker, Neuwied, A. Koch, Lauterbach "Oberflächenfluorierung von Textilien zur Erhöhung der Haftfestigkeit", Chemiefasern/Textilindustrie (Industrie Textilien), Volume 39/91, July/August 1989).

SUMMARY OF THE INVENTION

It is an object of the present invention to provide an improvement in the adhesion of fluoropolymer coatings on synthetic fibers and filaments and yarn and textile fabric made of synthetic fibers and filaments and also on sewing yarns which have been bonded with such fluoropolymer coatings.

This object is achieved according to the invention when the surfaces of the synthetic fibers are fluorinated and any fluoropolymer coating immediately adjoining the fabric surface is free of adhesion-promoting constituents.

It was found that, surprisingly, very firmly adherent fluoropolymer coatings can be produced on synthetic fiber and filament when the synthetic fiber surfaces have been gas phase fluorinated with gaseous fluorine.

The temperature and pressure of the fluorine/carrier gas mixture with which the fluorination is carried out are not critical as long as the properties of the materials used (glass transition point, melting point, etc.) are respected. For practical reasons, however, the treatment is preferably carried out at room temperature and standard atmospheric pressure. This also holds for the fluorination employed in this invention.

Fluorination affects only the outer layers of the polymer material, and it is known from experience that the distribution of fluorine (F) in these layers is very homogeneous. It is therefore sensible to specify the fluorine content of the polymer in terms of mg of fluorine per unit area. For technical reasons this value is frequently determined by first determining the fluorine content of the filaments contained in the sample, per unit weight, and then converting this fluorine content per unit weight to the surface area of the filaments by using the filament diameter and the density of the filaments.

DETAILED DESCRIPTION OF PREFERRED EMBODIMENTS

According to the invention, the fluorine concentration of the fluorination atmosphere is in the range from 0.1 to 10% and the synthetic fibers have a fluorine content in the range from $1.3\times10^{-4}$ to $1.2\times10^{-2}$ mg F/cm$^2$. Furthermore, the fluorine concentration can be in the range from 0.1 to 5%. Preference is given to a fluorine concentration in the range from 0.1 to 2% and especially in the range from 0.1% to 1%.

The measured fluorine content per unit weight was determined by burning the particular fluorinated sample (without aftertreatment) in a pure $O_2$ atmosphere and absorbing the resultant combustion gases in $H_2O$ (Schöninger analysis). The aqueous solution was filtered and injected into an ion chromatograph (DIONEX DX 120). The measured chromatogram was quantitatively evaluated via the peak areas after external calibration with standard fluoride solutions. The amount of sample analyzed was 30–100 mg, depending on the fluorine content, which was determined in a preliminary test. The detection limit of the method employed is 17 mg of fluorine per 1 kg of sample material, and the determination limit is 46 mg F/kg.

In a further embodiment of the invention, the synthetic fiber has a hydrophobic Lowick finish. Similarly, however, the synthetic fibers can be free of Lowick finish.

The invention is further developed as per the features of claims 10 to 15.

The invention further provides a yarn composed of synthetic fibers or filaments coated with fluoropolymer, characterized in that the synthetic fibers or filaments are surface fluorinated and in that any fluoropolymer coating immediately adjoining the synthetic fiber or filament surfaces is free of adhesion-promoting constituents. Here, the fluoropolymer coating has an adhesive strength such that exposure to mechanical stresses of the kind occurring in the further processing of yarn from the fibers or filaments leaves the fluoropolymer coating adherent and defect free.

The invention also provides fluoropolymer-bonded sewing yarn characterized in that the surfaces of the synthetic fibers or filaments of which the sewing yarn is composed are fluoropolymer fluorinated and in that the fluoropolymer coating which provides a direct elastic and flexible bond between the individual fibers or filaments is free of adhesion-promoting constituents. Here, the bonding fluoropolymer coating has an adhesive strength such that exposure to mechanical stresses as occur in the course of sewing leave the fluoropolymer coating undetached from the synthetic fibers or filaments.

The process which the invention provides for producing textile fabrics from synthetic fibers comprises a first step of fluorinating the synthetic fibers in a fluorine/carrier gas atmosphere and a second step of coating the fluorinated synthetic fibers with an aqueous fluoropolymer coating on both sides of the fabric.

In an embodiment of the process, the fabric is sintered for up to two minutes at a temperature from 180 to 210° C. Preferably, first the front of the fabric is sintered for up to two minutes at a temperature from 180 to 210° C. and, after the front, the back of the fabric is sintered for up to two minutes at a temperature from 180 to 210° C. A simultaneous coating of front and back is likewise possible, in which case it is preferable to employ a sintering time from 2 to 3 minutes.

In a further development of the process, plural layers of aqueous fluoropolymer composition are applied to both sides of the fabric and each sintering operation for an applied layer is followed by an intervening drying for up to two minutes at a temperature from 180 to 210° C.

Preferably, the fabric is fully sintered at a temperature up to 210° C. for from six to ten minutes after the last layer has been applied.

The process for producing fluorine-coated yarn from synthetic fibers or filaments comprises a first step of fluorinating the yarn in a fluorine/carrier gas atmosphere and a second step of dipping the fluorinated yarn into an aqueous fluoropolymer composition.

In a further embodiment of the process, the yarn is heated for from one to two minutes in an environment which has a temperature from 180 to 220° C.

Bonded sewing yarn is produced in a process which comprises a first step of fluorinating the sewing yarn in a fluorine/carrier gas atmosphere and a second step of the fluorinated sewing yarn being dipped into an aqueous fluoropolymer composition and impregnated to an add-on level of 14 to 21% by weight of dry add-on, based on the sewing yarn weight.

In a further process step, the impregnated sewing yarn is heated for from one to two minutes in an environment whose temperature is in the range from 180 to 220° C.

Yarn according to the invention finds use in the production of textile fabrics, wovens, formed-loop knits, nonwoven scrims, nonwovens, layered products formed from identical or different textile fabrics.

Textile fabrics according to the invention are used for producing flexible containers, compensators, bellows, awnings, tents, air-houses, membranes, conveyor belts, fabric tubes and the like.

Textile fabrics for the purposes of the invention are two-dimensional structures, for example formed-loop knits, wovens, nonwoven scrims or nonwovens of various thicknesses, similarly layered products formed from identical or different sheet materials, if necessary combined with application-specific mixing components. These are for example pigments, fillers, flame retardants and modifiers, such as softeners, lubricants which modify the surface properties of the fluoropolymer coating, such as slip friction modifiers for example.

Yarns, filaments or fibers according to the invention are threads which have been coated with a fluoropolymer composition and are used as threads or yarns.

The filaments or fibers can be dyed or undyed, flat or textured. The fluoropolymer coating can in principle be applied in one operation to the synthetic fiber material to be coated. To produce comparatively thick fluoropolymer layers, these are applied layer by layer in a plurality of operations, and depending on the composition chosen for the fluoropolymer coating and the associated consistency the synthetic fibers may be impregnated by dipping, padding or paste application, for example by knife-coating or roller-coating. When a plurality of fluoropolymer layers are applied, it is preferable for the first layer, i.e. the basecoat, to be applied using a fluoropolymer coating which contains no or little other additives, especially no solid additives such as for example pigments or flame retardants. The topcoat or topcoats can then be executed using a normal aqueous fluoropolymer dispersion or paste which may contain further additives such as for example dispersants, wetting agents, pigments, flame retardants or other filling and auxiliary materials. The topcoat can also be applied by means of known coating processes for elastomers, for example roll melt applicators or extrusion processes. The application of the fluoropolymer finish in a single operation, for example by impregnating, is advantageous for applying the fluoropolymer coating to threads composed of synthetic fibers or filaments.

Useful fiber materials include polyester, polyamide or aramid synthetic fibers. They can be dyed or undyed, flat or textured. There is no evidence that commercial textile dyes will migrate out of the synthetic fibers into the fluoropolymer coating. Owing to the high mechanical strength properties of these fibers, the fluoropolymer-coated materials have excellent mechanical strength values which very greatly extend the range of their possible industrial uses. As well as the high mechanical strength values characteristic of these synthetic fibers, these fibers possess very lubricious, chemically resistant, weathering-resistant and soil-repellent surfaces after fluoropolymer coating.

This also holds for bonded sewing yarns which exhibit a particularly high strength and excellent sewing properties. Particularly good sewing yarns are obtained from KoSa GmbH & Co. KG's type 712, which is manufactured with a broad range for fineness and filament count (from 49 dtex for 16 filaments to 940 dtex for 200 filaments). By bonding of the sewing yarn is meant the flexible joining of the individual filaments of the yarn that is brought about by the fluoropolymer coating. The inert fluoropolymer coating does not even lose its bonding action as a result of the application of finishes to further improve the running property and to reduce yarn friction.

The coated synthetic fibers, threads and synthetic filaments and also the bonded sewing yarn exhibit substantial adhesive strengths for the fluoropolymer coating, so that mechanical stresses of the kind experienced in the further processing of the threads or in the intended use of the sewing yarn, for example in the course of rewinding, formed-loop knitting, weaving or sewing itself, do not lead to the fluoropolymer coating becoming detached.

The operative examples which follow illustrate the effect of fluorination on the adhesion of the fluoropolymer coating to textile fabrics.

Various series of tests were carried out, which led to comparable results and show that the adhesion between gas phase fluorinated fabrics woven from polyester yarns of type 710 and 711 (Lowick) from KoSa GmbH & Co. KG and also a specific polyester yarn composed of liquid-crystal polymer (Vectran® from Celanese) and a THV fluoropolymer paste (Hostaflon THV 340 C from Dyneon) without use of an additional adhesion promoter is equivalent to or even superior to the adhesion to nonfluorinated fabrics which are treated with a fluorocopolymer which contains an adhesion promoter.

Polyolefin (TPV 8291-80 TB from AES—Advanced Elastomer Systems) gave similarly positive adhesion effects for the fluoropolymer coating due to prior fluorination of the yarns as were observed in the case of the adhesion of type 710 polyester yarn.

In contrast, a PVC coating absolutely requires an additional adhesion promoter even after fluorination of the synthetic fibers to achieve adequate adhesion.

Performance of Tests

Test fabrics were woven in a P ½ construction from a 12 ends/cm warp of polyester monofilaments 0.15 mm in diameter and an 18 picks/cm filling of 1100 (1670) dtex 200 filament type T 710 polyester yarn, 1100 (1670) dtex 200 filament type T711 polyester yarn or 1670 dtex 300 filament Vectran® yarn. These yarn types are by virtue of their mechanical strength (T710, Vectran®) and their Lowick property (T711 Lowick) particularly suitable for textile building construction and for the manufacture of transportation systems respectively.

The fabric samples which were generally not given a further treatment prior to fluorination are identified as "standard" in tables 1, 2 and 3 below. In the case of type T711, an additional test was carried out using a fabric sample which was washed prior to fluorination in order that impurities (e.g. finish constituents) be removed from the surface. To this end, the fabric samples were washed in an apparatus containing a volume of 2001 of water at a liquor ratio of about 133:1 in accordance with the following temperature-time program:

| | Stage | | | | | |
|---|---|---|---|---|---|---|
| | 1 | 2 | 3 | 4 | 5 | 6 |
| Temperature (° C.) | 60 | 80 | 80 | 60 | 40 | cold |
| Time (min) | 20 | 20 | 20 | 20 | 20 | 20 |

The liquor add has the following composition (in g/l):

| | Stage | | |
|---|---|---|---|
| | 1 | 2 | 4 |
| Hydrosulfite | 2 | | |
| Emulsogen EL | 2 | | |
| Hostapal FA | 0.5 | 0.5 | |
| Sod ash | 2 | 5 | |
| Acetic acid 60% | | | 0.5 |

The other washing stages utilized water only, without further adds.

Not only the "standard" fabric samples but also the washed fabric samples were subjected, prior to coating, to a gas phase fluorination in a fluorine/carrier gas atmosphere having a fluorine concentration in the range from 0.5 to 10%. More particularly, an oxyfluorination was carried out in the range from 0.25 to 10% fluorine concentration in air, specifically using fluorine concentrations of 0.25%, 0.5%, 1%, 5% and 10%, the treatment time at room temperature (20 to 25° C.) and standard atmospheric pressure being 3 min in each case. The fluorine content of the individual synthetic fibers in the fabrics was up to $1.2\times10^{-2}$ mg F/cm$^2$.

A commercially available aqueous fluorocopolymer composed of tetrafluoroethylene, hexafluoropropylene and vinylidene fluoride structural units (THV 340 C from Dyneon) was thickened with a polyacrylate-based thickener (Viscalex VG2 from Ciba) by stirring in a kneader at room temperature of 20 to 25° C. for about 15 min. Useful fluorocopolymers include commercially available fluoropolymer preparations having 40 to 60% of tetrafluoroethylene structural units, 10 to 30% by weight of hexafluoropropylene structural units and 20 to 40% by weight of vinylidene fluoride polymer structural units. The fraction of the fluorocopolymer that is attributable to the thickener is in the range from 1 to 3% by weight, based on the fluorocopolymer weight. Stirring the aqueous fluorocopolymer with the thickener provides a pasty fluoropolymer mass which is very suitable for coating textile fabrics and yarns. This paste is especially useful as a basecoat in the coating of textile fabrics, atop which it is then possible to apply firmly adherent fluoropolymer topcoats using commercially available fluoropolymer pastes or dispersions that contain no thickener.

The tests were carried out by applying, to both sides, a basecoat using a paste from THV340 C from Dyneon, which had been thickened with 2% by weight of Viscalex VG2 thickener from Ciba. After the basecoat had been applied to the front of the textile fabric, the sample was sintered at 200° C. for 2 min before the back was treated in the same way. As a result, the front experienced a twofold thermal treatment.

The textile fabric was then welded to a material which had been coated with a commercially available fluorocopolymer (Fluorguard T) from Mehler Haku, in a 15 kW HF instrument under 5 bar pressure at a power output of 75% for a period of 15 sec.

The adhesive strength was measured in accordance with DIN 53530. The results are reported in tables 1 to 3.

The Lowick effect was determined using an internal laboratory test which measured the penetration of a test fluid into the edge of the coated fabric both in a horizontal and in a vertical arrangement of the samples.

This measurement was carried out on strips 2 cm wide and about 17 cm in length, cut in the filling direction out of the woven fabric to be investigated.

For the horizontal test (creep length), a hole 5 mm in size is die-cut in the center of each strip and sealed with adhesive tape (eg tesa® film) on the back of the sample. A solution of 0.5 g of methylene blue in 150 g of distilled water (methylene blue solution) is dripped into the resultant depression and allowed to draw in for three (3) hours; if necessary, the solution is replenished during this period. On expiry of the test time, excess solution is removed with water and the depth of penetration of the methylene blue solution (blue color) from the edge of the hole is determined in mm and entered as creep length in the test protocol.

In the vertical test, the hole is die-cut at the narrow end of the sample and this end is then dipped, with the sample held vertically, 10 mm deep into the methylene blue solution; the testing time is five (5) hours in this case. Thereafter, the sample is again cleaned up with water and the wicking height of the methylene blue solution from the edge of the strip is measured in mm. The measurement is repeated more than once to obtain a reliable average.

The values reported in the tables which follow come from the vertical test.

TABLE 1

| Polyester yarn type 711 | | | | | |
|---|---|---|---|---|---|
| Sample # | Characterization | Fluorine concentration [%] | Front adhesion [N/5 cm] | Back adhesion [N/5 cm] | Lowick after 5 h [mm] |
| A1 | standard | 0 | 72 | 57 | 1 |
| A2 | standard | 0.25 | 390 | 103 | 1 |
| A3 | standard | 0.5 | 400 | 400 | 0.5 |
| A4 | standard | 1 | 400 | 400 | 0.5 |
| A5 | standard | 5 | 148 | 120 | 1.5 |
| A6 | standard | 10 | 144 | 148 | 16 |
| A7 | washed | 0 | 85 | 54 | 0.5 |
| A8 | washed | 0.25 | 400 | 132 | 0.5 |
| A9 | washed | 0.5 | 410 | 400 | 0.5 |
| A10 | washed | 1 | 400 | 400 | 0.5 |
| A11 | washed | 5 | 340 | 310 | 1.3 |
| A12 | washed | 10 | 132 | 110 | 15 |

TABLE 2

| Polyester yarn type 710 | | | | | |
|---|---|---|---|---|---|
| Sample # | Characterization | Fluorine concentration [%] | Front adhesion [N/5 cm] | Back adhesion [N/5 cm] | Lowick after 5 h [mm] |
| B1 | standard | 0 | 72 | 57 | 39 |
| B2 | standard | 0.25 | 390 | 103 | 43 |
| B3 | standard | 0.5 | 400 | 400 | 47 |
| B4 | standard | 1 | 400 | 400 | 52 |
| B5 | standard | 5 | 123 | 131 | 65 |
| B6 | standard | 10 | 133 | 149 | 85 |

TABLE 3

| Specialty polyester type (Vectran ®) | | | | | |
|---|---|---|---|---|---|
| Sample # | Characterization | Fluorine concentration [%] | Front adhesion [N/5 cm] | Back adhesion [N/5 cm] | Lowick after 5 h [mm] |
| C1 | standard | 0 | 103 | 87 | 57 |
| C2 | standard | 1 | 462 | 478 | 61 |

The samples bearing the index 1 in tables 1 to 3 (fluorine concentration 0%) are the comparative samples which were treated with a fluorocopolymer without prior gas phase fluorination (blank sample).

The fluorine content of all the fluorinated samples can be calculated with sufficient accuracy in the investigated range from the fluorine concentration by the formula $$\text{fluorine content } (mg\ F/cm^2) = 8.8\times10^{-4}\times\text{fluorine concentration } (\%) + 5.1\times10^{-5}.$$

Figure 2:
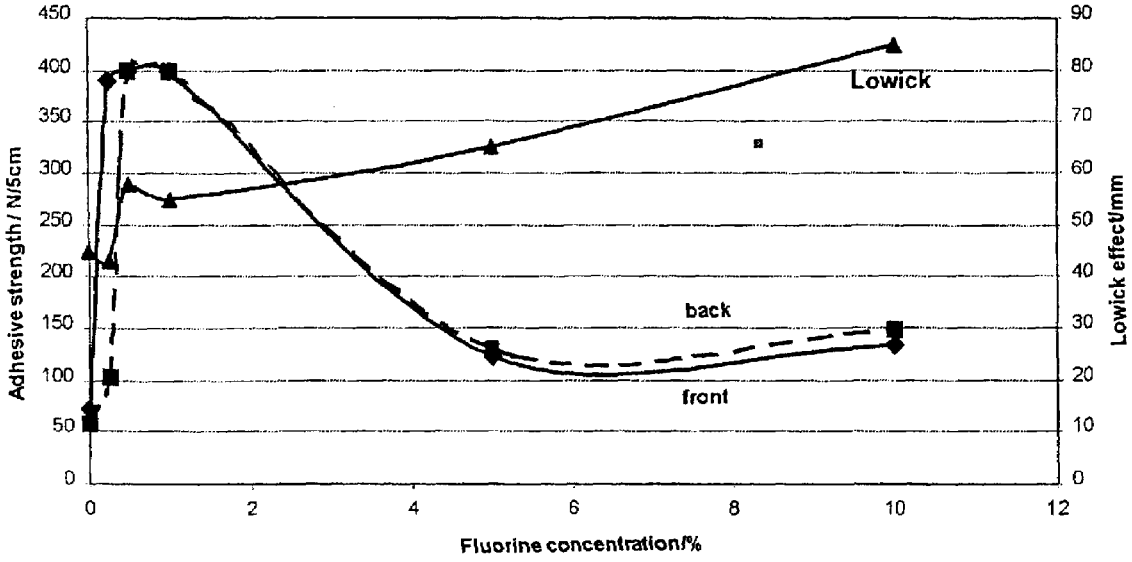

As shown by tables 1 and 2 and illustrated by the associated FIGS. 1 and 2, adhesion is improved by fluorination in all cases compared with the blank sample and reaches a maximum at low fluorine concentrations between 0.25 and 1% (i.e. fluorine contents between $2.71\times10^{-4}$ and $9.3\times10^{-4}$ mg F/cm$^2$) under the given experimental conditions.

Adhesion drops off again substantially at higher fluorine concentration; in the case of the washed fabric sample from type T711, it is true that adhesion decreases more slowly, but at a fluorine concentration of 10% (which corresponds to a fluorine content of $8.9\times10^{-3}$ mg F/cm$^2$) it is back down almost to the level of the blank sample, like all the other samples.

The broader fluorine concentration range available for the fluorination to achieve good adhesion values in the case of the washed samples makes the fluorination process less sensitive to fluctuations in the fluorine concentration.

However, the advantage due to washing the yarn or fabric has to be judged against the further processing problems and the additional inconvenience and associated increased production costs.

The cause of the washing effect is not clear at present; it is believed that, in the case of the unwashed samples, the products which are formed by fluorination of impurities (spin finish constitutents etc.) present on the polymer surface and which do not enter a chemical bond with the polyester are increasingly formed at higher fluorine concentrations and so block adhesion at these sites. They disrupt the homogeneity of the coating, and this favors the penetration of water and so also contributes to the observed reduction in the Lowick effect.

Remarkably, not only the adhesion but also the Lowick effect of type 711 is increasingly adversely affected at fluorine concentrations above 4% ($3.6\times10^{-3}$ mg F/cm$^2$). Possible reasons for this include not only the possible cause just mentioned but also the literature-reported increasing hydrophilicization of the polyester.

The difference between the individual polyester types with regard to adhesion improvement due to fluorination appears to be only minimal, as a comparison of the values in tables 1–3 reveals; in contrast, there are distinct differences in the Lowick effect, which is altogether most stable in the case of the type T 711 which was specifically developed for this purpose.

FIGS. 1 and 2, which follow, depict the adhesion in N/5 cm as a function of the fluorine concentration in percent during the gas phase fluorination of the samples T 711 and T 710. These figures show the curve for the adhesion data reported in tables 1 and 2 as a function of the degree of fluorination.

Summary of Results

The Results Show:

a) Fluorination generally improves adhesion; it is only at fluorine concentrations above 2% that adhesion begins to decrease significantly, and reaches the level of the unfluorinated samples at fluorine concentrations of about 10%. Fluorine concentrations from about 0.25% to 1% provide the highest adhesion values.

b) Washed samples exhibit distinctly improved adhesion compared with standard at fluorine concentrations above 2%, which is indicative of lower sensitivity to changes in the fluorine concentration during fluorination.

c) Small differences in the values for the front and the back of the samples could be indicative of an effect due to the sintering conditions, i.e. to the twofold thermal treatment of the front compared with the just single thermal treatment of the back of the samples.

d) The differences between the two types used, 710 and 711, not only in the absolute level of the values but also in the values for the front and the back of the samples are only minimal and are probably due to the Lowick finish of type 711, which is very difficult to remove even by washing.

e) The THV adhesion of the unfluorinated samples is below 100 N/5 cm and hence insufficient for many applications in the industrial sector, since adequate serviceability only comes about at values from 100 N/5 cm to 150 N/5 cm. There are some applications where even adhesion values of more than 200 N/5 cm are desirable, which are very difficult to achieve with adhesion promoters.

An optimized fluorine treatment achieves this according to the invention without additional adhesion promoter (see samples A3, A4, B3, B4 and C2). An optimized fluorine treatment further offers the advantage that the influence of the treatment method on the physical properties of the fabrics is less than with the use of adhesion promoters.

Bonding of a Sewing Yarn

A black 266 dtex 64 filament 3 ply polyethylene terephthalate sewing yarn as described in example 6 of EP 0 327 047 B1 is gas phase fluorinated and impregnated in a fluorocopolymer preparation as used in the previously described tests by dipping to an add-on amount of 14 to 21% by weight of dry add-on, based on the yarn weight. The sewing yarn thus impregnated is then heat treated in a hot oven at 180 to 220° C. for 1 to 2 min.

To this end, as above for the dip impregnation and coating of fabrics, an aqueous fluoropolymer dispersion is prepared for example by mixing 2% by weight of a wetting and dispersing agent based on an ethoxylated alkylphenol, 35% by weight of a fluorocopolymer and 63% by weight of deionized water. To this end, the wetting and dispersing agent is first dissolved in water and subsequently the finely ground fluorocopolymer of 55% by weight of tetrafluoroethylene, 15% by weight of hexafluoropropylene and 30% by weight of vinylidene fluoride is gradually introduced into the water and the mixture is stirred until the dispersion is completely homogenized.

Similarly, the above-described dip impregnation can also be effected with a commercially available 35% fluoropolymer dispersion (THV 340 C® from Dyneon).

To test the quality of the sewing yarn produced, it is subjected to the sewing test described in DE-A 34 31 834. When sewn up using an industrial sewing machine, the bonded sewing thread permits on average 4 000 stitches without broken end, while an unbonded thread permits on average only about 300 stitches without breaking.

The sewing thread exhibits no signs of migration of the dye into the bonding, nor any changes in hue. Nor is any abrasion observed during sewing or winding, nor is there any adhesive coalescing of yarn layers following prolonged storage on a bobbin.

What is claimed is:

1. Yarn composed of synthetic fibers or filaments coated with fluoropolymer, characterized in that the synthetic fibers or filaments are surface fluorinated and in that any fluoropolymer coating adhesively joins the individual filaments of the yarn and is free of adhesion-promoting constituents.

2. Yarn as claimed in claim 1, characterized in that the fluoropolymer coating has an adhesive strength such that exposure to mechanical stresses of the kind occurring in the further processing of yarn from the fibers or filaments leaves the fluoropolymer coating adherent and defect free.

3. Fluoropolymer-bonded sewing yarn, characterized in that the surfaces of the synthetic fibers or filaments of which the sewing yarn is composed are fluorinated with gaseous fluorine and in that the fluoropolymer coating which provides a direct elastic and flexible bond between the individual fibers or filaments is free of adhesion-promoting constituents.

4. Sewing yarn as claimed in claim 3, characterized in that the bonding fluoropolymer coating has an adhesive strength such that exposure to mechanical stresses as occur in the course of sewing leave the fluoropolymer coating undetached from the synthetic fibers or filaments.

5. The yarn of claim 1 forming flexible containers, compensators, bellows, awnings, tents, air-houses, membranes, conveyor belts, fabric tubes, transportation systems.

6. The yarn of claim 1 forming textile fabrics, wovens, formed-loop knits, nonwoven scrims, nonwovens, layered products formed from identical or different textile sheet materials.

7. A process for producing a textile fabric from the yarn of claim 1 which comprise a first step of fluorinating the synthetic fibers in fluorine/carrier gas atmosphere and a second step of coating the fluorinated synthetic fibers with an aqueous fluoropolymer composition on both sides of the fabric.

8. A process as claimed in claim 7, wherein the fabric is sintered for up to two minutes at a temperature from 180 to 210° C.

9. A process as claimed in claim 8, wherein first the front of the fabric is sintered for up to two minutes at a temperature from 180 to 210° C.

10. A process as claimed in claim 9, wherein, after the front, the back of the fabric is sintered for up to two minutes at a temperature from 180 to 210° C.

11. A process as claimed in claim 7, wherein plural layers of aqueous fluoropolymer composition are applied to both sides of the fabric and each sintering operation for an applied layer is followed by an intervening drying for up to two minutes at a temperature from 180 to 210° C.

12. A process as claimed in claim 11, wherein the fabric is fully sintered at a temperature up to 210° C. for from six to ten minutes after the last layer has been applied.

13. A process for producing yarn from synthetic fibers or filaments as claimed in claim 1, which comprises a first step of fluorinating the yarn in a fluorine/carrier gas atmosphere and a second step of dipping the fluorinated yarn into an aqueous fluoropolymer composition.

14. A process as claimed in claim 13, wherein the yarn is heated for from one to two minutes in an environment which has a temperature from 180 to 220° C.

15. A process for producing a bonded sewing yarn as claimed in claim 3, which comprises a first step of fluorinating the sewing yarn in a fluorine/carrier gas atmosphere and a second step of the fluorinated sewing yarn being dipped into an aqueous fluoropolymer composition and impregnated to an add-on level of 14 to 21% by weight of dry add-on, based on the sewing yarn weight.

16. A process as claimed in claim 15, wherein the impregnated sewing yarn is heated for from one to two minutes in an environment whose temperature is in the range from 180 to 220° C.

* * * * *